US009131739B1

(12) United States Patent
Sjoquist

(10) Patent No.: US 9,131,739 B1
(45) Date of Patent: Sep. 15, 2015

(54) MAGNETIC FASTENER

(71) Applicant: CJM2, Inc., Las Vegas, NV (US)

(72) Inventor: Clarisse Sjoquist, Las Vegas, NV (US)

(73) Assignee: CJM2, INC, Las Vegas, NV (US)

( * ) Notice: Subject to any disclaimer, the term of this patent is extended or adjusted under 35 U.S.C. 154(b) by 0 days.

(21) Appl. No.: 14/504,004

(22) Filed: Oct. 1, 2014

Related U.S. Application Data

(63) Continuation of application No. 14/210,946, filed on Mar. 14, 2014.

(51) Int. Cl.
*A44B 1/04* (2006.01)
*A41F 1/00* (2006.01)

(52) U.S. Cl.
CPC .. *A41F 1/002* (2013.01); *A44B 1/04* (2013.01)

(58) Field of Classification Search
CPC ..... A41F 1/002; A44D 2203/00; Y10T 24/32
USPC ..... 24/303
See application file for complete search history.

(56) References Cited

U.S. PATENT DOCUMENTS

| | | | | |
|---|---|---|---|---|
| 2,389,298 | A | 11/1945 | Ellis | |
| 2,389,299 | A | 11/1945 | Ellis | |
| 2,397,931 | A | 4/1946 | Ellis | |
| 3,111,737 | A | 11/1963 | Heil | |
| 3,141,216 | A | 7/1964 | Brett | |
| 3,324,521 | A | 6/1967 | Humiston | |
| 3,372,443 | A | 3/1968 | Daddona | |
| 4,265,002 | A | 5/1981 | Hosken | |
| 4,399,595 | A | 8/1983 | Yoon et al. | |
| 4,453,294 | A | 6/1984 | Morita | |
| D289,137 | S | 4/1987 | Aoki | |
| 4,736,494 | A | 4/1988 | Marchesi | |
| 4,847,959 | A | 7/1989 | Shimada et al. | |
| 4,924,559 | A | 5/1990 | Marchesi | |
| 5,042,116 | A * | 8/1991 | Ossiani | 24/303 |
| 5,103,501 | A | 4/1992 | Meisels | |
| 5,125,134 | A | 6/1992 | Morita | |

(Continued)

FOREIGN PATENT DOCUMENTS

CN 2624656 Y 7/2004

OTHER PUBLICATIONS

English language abstract for CN2624656 extracted from espacenet.com database on Aug. 20, 2014, 1 page.

*Primary Examiner* — Robert J Sandy
*Assistant Examiner* — Matthew Sullivan
(74) *Attorney, Agent, or Firm* — Howard & Howard Attorneys PLLC

(57) ABSTRACT

An article including a first section of material, a second section of material, and a magnetic button assembly comprising a first component and a second component. The first component has a ring magnet and a body portion with the body portion having a fastening region with a first thread disposed therethrough for coupling the first component to the first section. A second thread passes though the second component for coupling the second component to the second section, and comprises at least one of a magnet and a ferromagnetic material to couple the second component to the first component thereby coupling the second section to the first section. The fastening region is formed of a polymeric material to minimize frictional wear of the first thread to prevent separation of the first component from the first section.

23 Claims, 7 Drawing Sheets

(56) References Cited

U.S. PATENT DOCUMENTS

| | | | | |
|---|---|---|---|---|
| 5,255,417 | A | 10/1993 | Herman | |
| 5,450,658 | A | 9/1995 | Hicks | |
| 5,604,960 | A | 2/1997 | Good | |
| 5,707,091 | A | 1/1998 | Morita | |
| 5,920,966 | A * | 7/1999 | Chen | 24/303 |
| 5,926,925 | A | 7/1999 | Hicks | |
| 6,163,938 | A | 12/2000 | Weber-Unger | |
| 6,215,381 | B1 * | 4/2001 | Aoki | 335/207 |
| 6,226,842 | B1 | 5/2001 | Wong | |
| 6,301,754 | B1 | 10/2001 | Grunberger et al. | |
| 6,378,174 | B1 | 4/2002 | Wong | |
| 6,473,946 | B1 | 11/2002 | Cheng | |
| 7,065,841 | B2 * | 6/2006 | Sjoquist | 24/303 |
| 7,178,207 | B2 | 2/2007 | Wong et al. | |
| 8,287,034 | B2 * | 10/2012 | Smith et al. | 296/191 |
| 8,596,090 | B1 * | 12/2013 | Smith | 63/29.2 |
| 2002/0095751 | A1 | 7/2002 | Reiter | |
| 2004/0200043 | A1 * | 10/2004 | Wong et al. | 24/303 |
| 2005/0177985 | A1 * | 8/2005 | Sjoquist | 24/104 |
| 2014/0130228 | A1 | 5/2014 | Horton | |
| 2014/0143985 | A1 * | 5/2014 | Horton | 24/303 |

* cited by examiner

FIG. 5
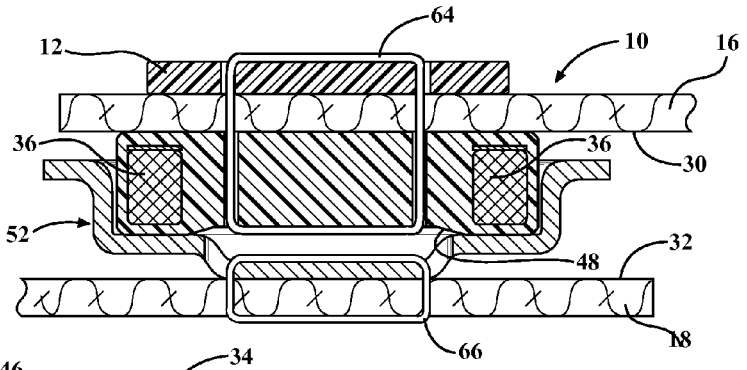
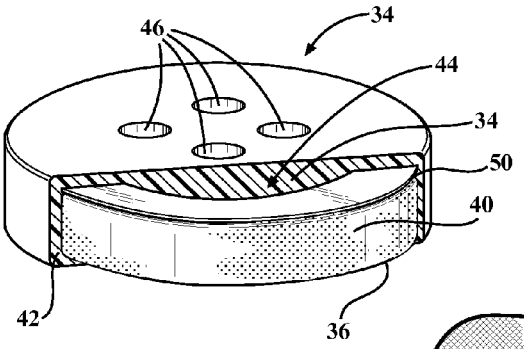
FIG. 6
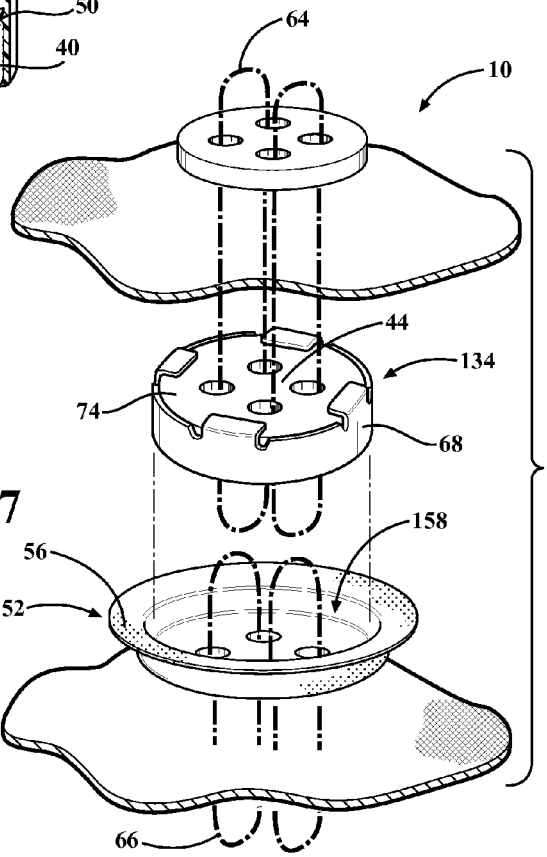
FIG. 7

FIG. 13
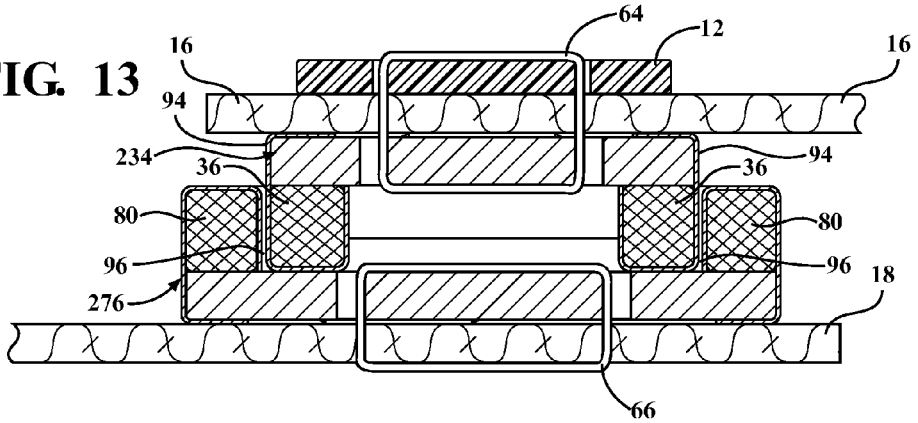
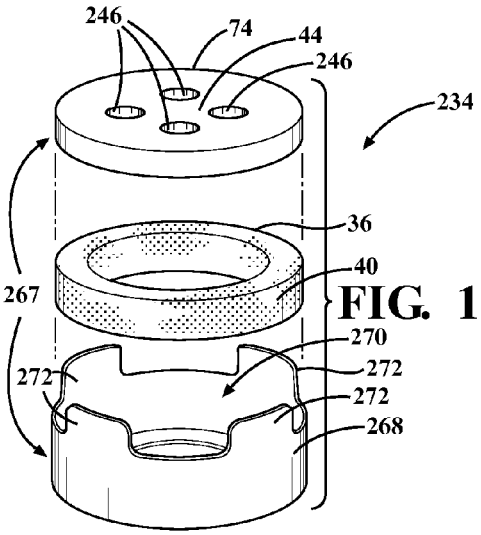
FIG. 14
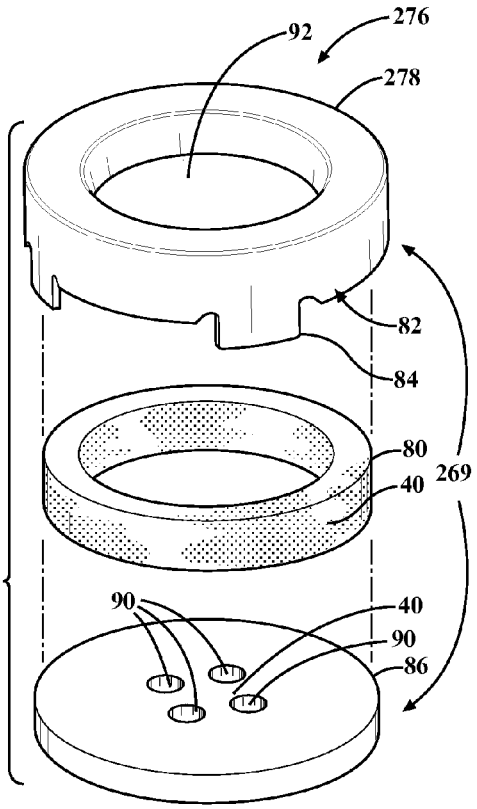
FIG. 15

MAGNETIC FASTENER

CROSS-REFERENCE TO RELATED APPLICATIONS

The subject patent application is a continuation of co-pending U.S. patent application Ser. No. 14/210,946, filed on Mar. 14, 2014, the disclosure of which is hereby incorporated by reference.

BACKGROUND OF THE INVENTION

1. Field of the Invention

The subject invention relates to fasteners that function by utilizing magnetism.

2. Description of the Related Art

Numerous magnetic fasteners are well know in the prior art. Although the magnetic fasteners appear to be effective, a person with only gross motor skills would have difficulty operating the magnetic fasteners. Persons who lack fine motor skills often have difficulty with daily task that most people take for granted. Putting on and removing clothing is often extremely difficult for those with only gross motor coordination. Operating a normal button-to-button-hole assembly, without assistance from another person, is sometimes impossible for these individuals. Accordingly, there remains an opportunity for a magnetic fastener that is easily operable by a person lacking fine motor skills.

SUMMARY OF THE INVENTION AND ADVANTAGES

The present invention overcomes the disadvantages in the related art in an article including a first section of material having a first surface and a second section of material having a second surface. The article further includes a magnetic button assembly. The magnetic button assembly includes a first component coupled to the first section of material adjacent the first surface. The first component has a ring magnet that defines a central opening and a body portion coupled to the ring magnet. The body portion has a fastening region that defines a first plurality of apertures disposed across the central opening. The article also includes a second component coupled to the second section of material adjacent the second surface. The second component defines a second plurality of apertures and comprises at least one of a magnet and a ferromagnetic material to magnetically couple the second component to the first component thereby coupling the second section of material to the first section of material. A first thread is disposed through the first plurality of apertures of the fastening region to secure the first component to the first section of material. A second thread is disposed through the second plurality of apertures to secure the second component to the second section of material. The fastening region of the body portion is formed of a polymeric material to minimize frictional wear of the first thread to prevent separation of the first component from the first section of material.

The present invention is also a magnetic button assembly for coupling a first section of material to a second section of material. The magnetic button assembly includes a first component. The first component has a ring magnet that defines a central opening, and a body portion coupled to the ring magnet. The body portion has a fastening region that defines a first plurality of apertures disposed across the central opening for permitting the first component to be secured to the first section of material. The magnetic button assembly also includes a second component. The second component defines a second plurality of apertures for permitting the second component to be secured to the second section of material. The second component includes at least one of a magnet and a ferromagnetic material to magnetically couple the second component to the first component for coupling the second section of material to the first section of material. The fastening region of the body portion is formed of a polymeric material.

In this way, the article is easy to operate and is especially useful for persons who lack fine motor coordination. Furthermore, when the article is used on apparel, a handle can be embodied as a button to provide increased aesthetic value.

BRIEF DESCRIPTION OF THE DRAWINGS

Other advantages of the present invention will be readily appreciated, as the same becomes better understood by reference to the following detailed description when considered in connection with the accompanying drawings.

FIG. 5 is a cross-sectional view of the first embodiment of the article after the first component and the second component are coupled together.

FIG. 6 is a fragmented perspective view of the first component of the first embodiment of the article.

FIG. 7 is an exploded perspective view of a second embodiment of the article.

FIG. 13 is a cross-sectional view of the third embodiment of the article after the first component and the second component are coupled together.

FIG. 14 is an exploded perspective view of the first component of the third embodiment of the article.

FIG. 15 is an exploded perspective view of the second component of the third embodiment of the article.

DETAILED DESCRIPTION OF THE INVENTION

Figure 1:
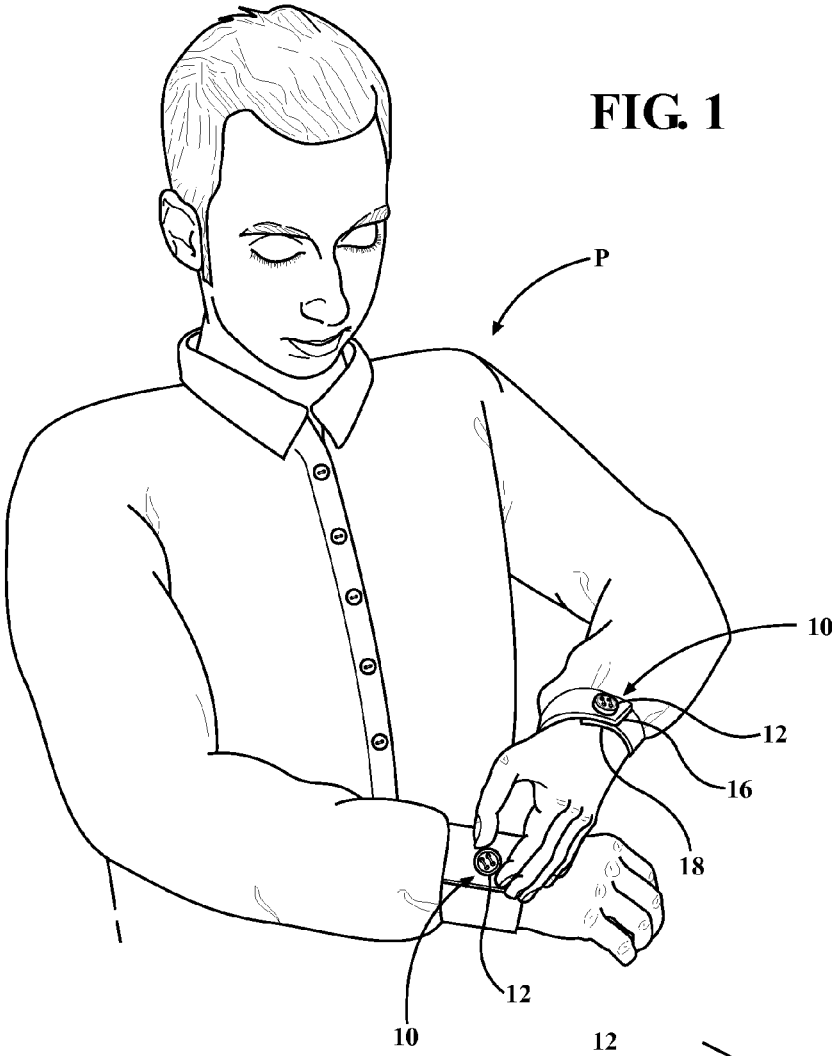
FIG. 1 is a perspective view of a person operating an article in accordance with the subject invention.
Figure 2:
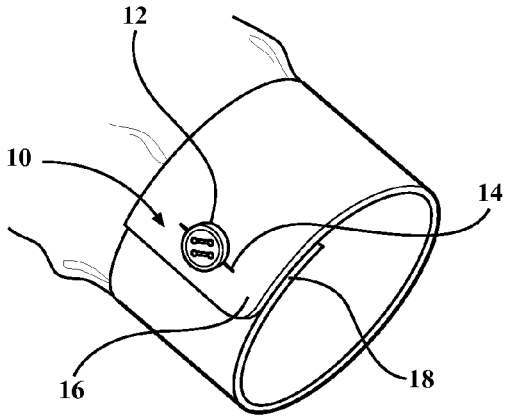
FIG. 2 is a perspective view of the article used on a sleeve of a piece of clothing.

With reference to the Figures, wherein like numerals indicate like parts throughout the several views, an article is shown at 10 in FIGS. 1 and 2. The article 10 may include a handle 12 to make the article 10 easily operable by a person P with only gross motor skills. The article 10 has the outward appearance of a standard button-to-buttonhole assembly. A buttonhole stitch 14 may be added to give the article the complete appearance of a standard button-to-buttonhole assembly. Wearing a garment that looks "normal" helps increase the feeling of self-worth of the person P having only gross motor skills. It should be appreciated that the use of the article 10 is not limited to clothing. Alternatively, the article 10 can also be used with handbags, purses, wallets, or any other suitable device. Those skilled in the art will recognize many other implementation of the article 10.

Figure 3:
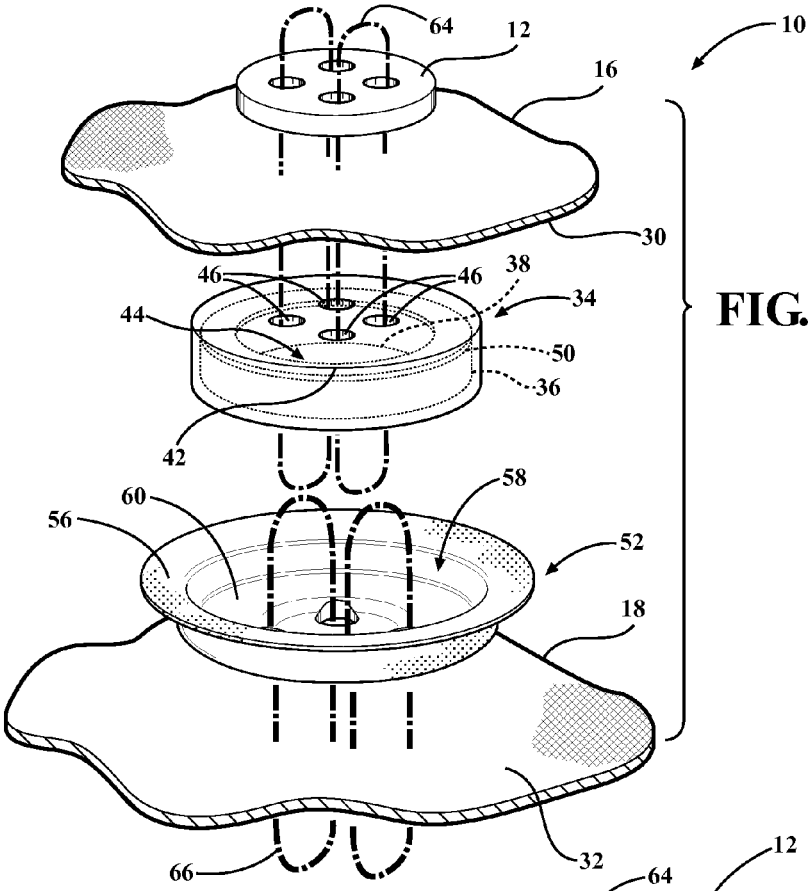
FIG. 3 is an exploded perspective view of a first embodiment of the article.
Figure 4:
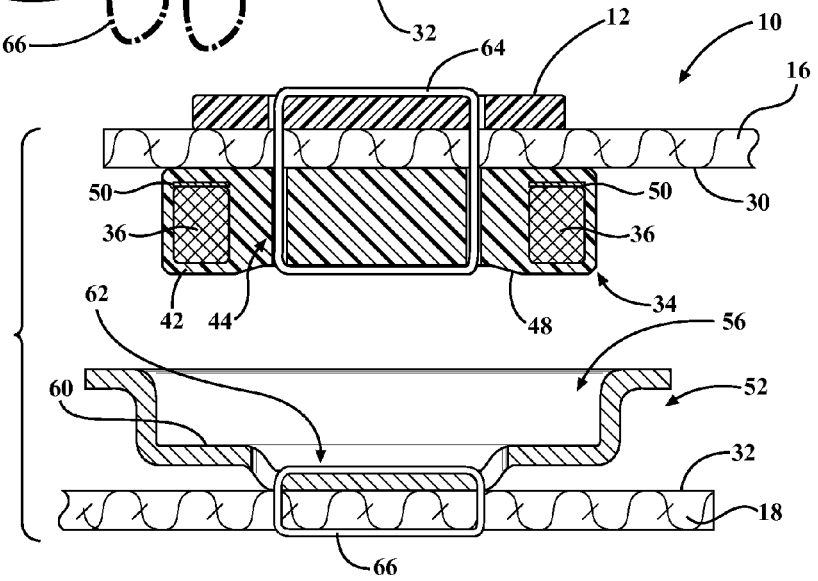
FIG. 4 is a cross-sectional view of the first embodiment of the article before a first component and a second component are coupled together.

The article 10 includes a first section of material 16 and a second section of material 18. Referring to FIGS. 3-5, the first section of material 16 has a first surface 30, and the second section of material 18 has a second surface 32. The first section of material 16 and the second section of material 18 may be formed of a textile material. The textile material may be further defined as leather, cotton, silk, linen, wool, hemp, jute, or any other like material.

As stated above, the article 10 includes a handle 12. The handle 12 couples to the first section of material 16, and the handle 12 is disposed on the first section of material 16 opposite the first surface 30. The handle 12 may be further defined as a button. The button has the shape and appearance of a standard four hole button, and is easily coupled to the first section of material 16 by an industrial sewing machine.

The article 10 also includes a magnetic button assembly. Referring to FIGS. 3-6, a first embodiment of the magnetic button assembly includes a first component 34 coupled to the first section of material 16. The first component 34 is coupled to the first section of material 16 adjacent the first surface 30. The first component 34 has a ring magnet 36 and the ring magnet 36 defines a central opening 39.

The ring magnet 36 may be further defined as a permanent magnet. The permanent magnet may be formed of any number of suitable materials such as ceramic, ferrite, alnico, cobalt, rare earth, neodymium, and any other type of permanent magnet. Depending on the type of permanent magnet utilized, the ring magnet 38 without a coating may be subjected to rust when washed or exposed to other sources of moisture. As such, the ring magnet may include a first coating 40 to prevent corrosion (see FIG. 6). Preferably, the first coating 40 is a fluoropolymer resin, such as Teflon® manufactured by E.I. DuPont de Nemours and Company of Wilmington, Del. Those having an ordinary skill in the art will appreciate that Teflon® has excellent resistance to both corrosion and high temperatures, making it very suitable to withstand a standard machine washing and drying cycle. Furthermore, those having an ordinary skill in the art will realize that other coatings, such as, but not limited to, nickel, will also produce acceptable corrosion resistance. It is to be appreciated that the ring magnet 38 could be used without a coating without departing from the scope of the present invention.

The first component 34 may also include a deflection element 50 coupled to the ring magnet 36 to direct a magnetic field emanating from the ring magnet 36. In the embodiment shown in FIGS. 3-6, the deflection element 50 is a metal plate. The metal plate is further defined as a thin metal plate disposed adjacent the ring magnet 36, and coupled thereto, for directing the magnetic field emanating from the ring magnet 36. In one embodiment, the deflection element 50 abuts the ring magnet 36. In another embodiment, the deflection element 50 is glued to the ring magnet 36. As best shown in FIGS. 5 and 6, the deflection element 50 is placed behind the ring magnet 36 to direct the magnetic field emanating from the ring magnet 36 away from the first section of material 16.

It is to be appreciated that a coating may be coupled to the ring magnet and the coating may also act as the deflection element to direct the magnetic field emanating from the ring magnet 36. The coating may be similar to those discussed above, or any alternative.

The first component 34 also includes a body portion 42 coupled to the ring magnet 36, and the body portion includes a fastening region 44. As best shown in FIG. 6, the body portion 42 is entirely formed of a polymeric material, and the body portion 42 and the fastening region 44 are preferably formed simultaneously. The polymeric material may be further defined as thermoset polymeric material, a thermoplastic polymeric material, or any other suitable polymer or plastic material. It is to be appreciated that the body portion 42 may not be entirely formed of a polymeric material and may be formed separately from the fastening region 44.

The body portion 42 encapsulates the ring magnet 36. The body portion 42 couples to the ring magnet 36 and the metal plate 50 to encapsulate the ring magnet 36 and the metal plate 50. The body portion 42 may encapsulate the ring magnet 36 and the metal plate 50, such that the body portion 42 completely surrounds the ring magnet 36 and the metal plate 50. Alternatively, the body portion 42 may encapsulate the ring magnet 36 and metal plate 50, such that the body portion 42 only surrounds a portion of the ring magnet 36 and metal plate 50.

The fastening region 44 defines a first plurality of apertures 46 disposed across the central opening 38. The first plurality of apertures 46 may be further defined as four apertures radially spaced with respect to the fastening region 44. It is to be appreciated that the first plurality of apertures 46 may also include any number of apertures spaced in any suitable configuration. The fastening region 44 of the body portion 42 may include a depression 48 where the first plurality of apertures 46 are disposed through the depression 48.

The article 10 also includes a first thread 64. The first thread 64 is disposed through the first plurality of apertures 46 of the fastening region 44 to secure the first component 34 to the first section of material 16. The first thread 64 may also secure the handle 12 to the first section of material 16. The fastening region 44 of the first component 34 is formed of a polymeric material to minimize frictional wear of the first thread 64 and to prevent separation of the first component 34 from the first section of material 16.

The magnetic button assembly also includes a second component 52 coupled to the second section of material 18 adjacent the second surface 32. The second component 52 defines a second plurality of apertures 54 radially spaced about a center of the second component 52. The second plurality of apertures 54 may be further defined as four apertures. It is to be appreciated that the second plurality of apertures 54 may include any number of apertures spaced in any suitable configuration.

The article 10 also includes a second thread 64. The second thread 64 is disposed through the second plurality of apertures 54 to secure the second component 52 to the first section of material 18.

The second component 52 is at least one of a magnet and a ferromagnetic material, and is used to magnetically couple the second component 52 to the first component 34 and thereby coupling the second section of material 18 to the first section of material 16. In the embodiment shown in FIGS. 3-6, the second component 52 is formed of a ferromagnetic material that includes Iron, Nickel, Cobalt, or any other similar material. It is to be appreciated that the second component 52 could be formed of any suitable metal that has magnetically attractive properties. The magnet and the ferromagnetic material creates an attraction between the first component 34 and the second component 52 by magnetically attracting the ring magnet 36 of the first component 34.

The second component 52 may include a second coating 56 to prevent corrosion of the second component 52. The second coating 56 helps to protect the second component 52 from rust and/or wear when the second component 52 is subjected to being washed or exposed to other sources of moisture. The second coating 56 is preferably like the first coating 40 and is a fluoropolymer resin, such as Teflon® manufactured by E.I. DuPont de Nemours and Company of Wilmington, Del. As discussed above, Teflon® has excellent resistance to both corrosion and high temperatures and is able to withstand a standard machine washing and drying cycle. Those skilled in the art will realize that other coatings, such as, but not limited to, nickel, will also produce acceptable corrosion resistance.

The second component 52 also includes a first depression 56 for receiving the first component 34, where the first depression 58 aligns the first component 34 with the second component 52. In one embodiment, and as best shown in FIGS. 3 and 4, the first depression 58 includes a floor 60 and a second depression 62 is formed in the floor 60. However, those skilled in the art will appreciate that the second component 52 could be designed without the second depression 62 without departing from the scope of the present invention. The second depression 62 creates a space for receiving the first thread 64 when the first component 34 and second component 52 magnetically couple to each other. The space prevents the first thread 64 from contacting the second component 52 when the first component 34 and the second component 52 magnetically couple to each other. By preventing the first thread 64 from contacting the second component 52, the second component 52 will not wear on the first thread 64.

Figure 8:
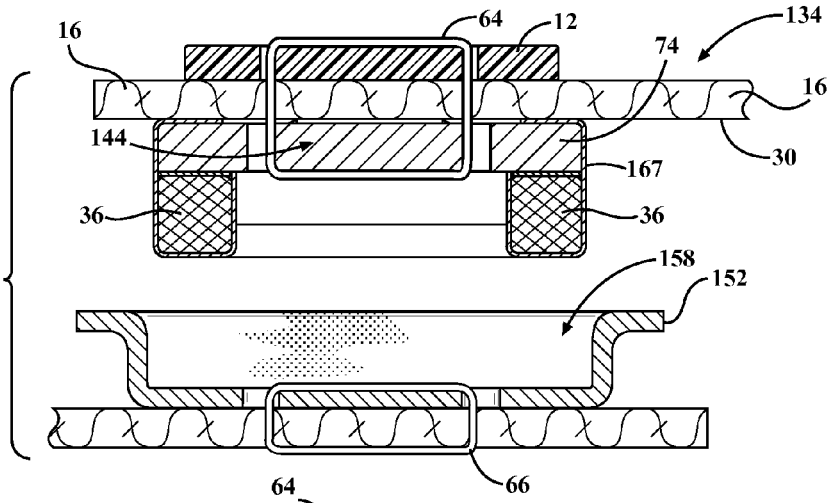
FIG. 8 is a cross-sectional view of the second embodiment of the article before a first component and a second component are coupled together.
Figure 9:
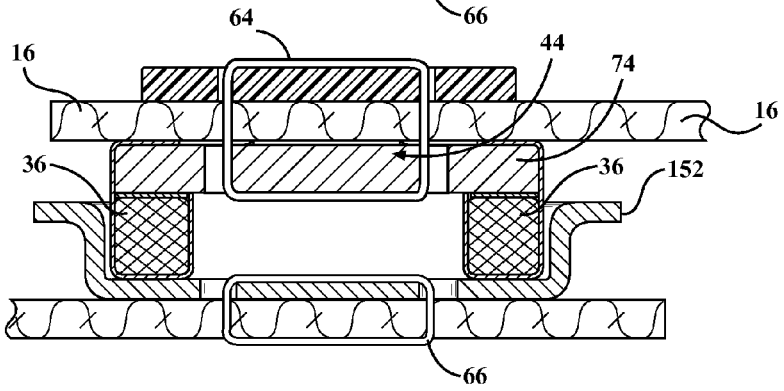
FIG. 9 is a cross-sectional view of the second embodiment of the article after the first component and the second component are coupled together.
Figure 10:
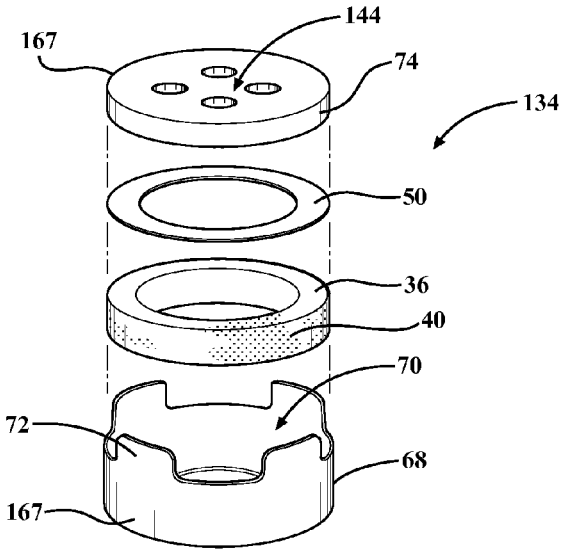
FIG. 10 is an exploded perspective view of the first component of the second embodiment of the article.
Figure 11:
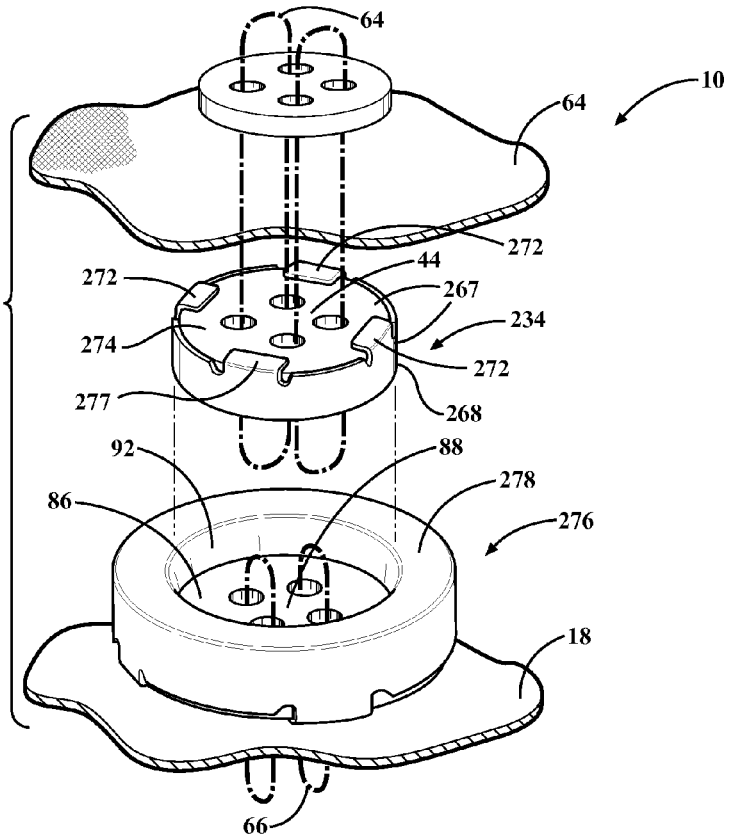
FIG. 11 is an exploded perspective view of a third embodiment of the article.
Figure 12:
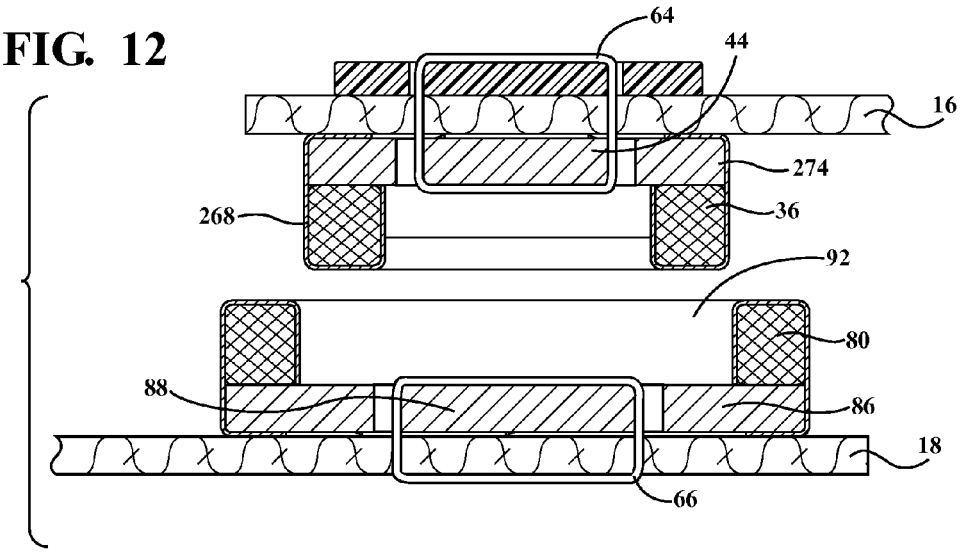
FIG. 12 is a cross-sectional view of the third embodiment of the article before a first component and a second component are coupled together.

Referring to FIGS. 7-10, another embodiment of the article 10 is shown wherein reference numerals increased by one-hundred represent like or similar elements. As best shown in FIG. 10, a first component 134 includes a body portion 167 having a first section 68. The first section 68 is formed of a metallic material and partially surrounds the ring magnet 36. The first section 68 may also partially surround the ring magnet 36 and the deflection element 50. As discussed above, the deflection element 50 is a metal plate coupled to the ring magnet 36 but could instead be a coating on the ring magnet 36. In one embodiment, the deflection element 50 abuts the ring magnet 36. In another embodiment, the deflection element 50 is glued to the ring magnet 36. As best shown in FIGS. 8-10, the deflection element 50 is placed behind the ring magnet 36 to direct the magnetic field emanating from the ring magnet 36 away from the first section of material 16. The first section 68 includes a pocket 70 for receiving the ring magnet 36. As shown in the Figures, the pocket 70 may also receive the deflection element 50. The first section 68 further includes a series of tabs 72 disposed about the pocket 70 for retaining the ring magnet 36 and the deflection element 50 within the pocket 70.

The body portion 167 also includes a second section 74 formed of a polymeric material, and the second section 74 defines a fastening region 144. As discussed above, the fastening region 144 of the second section 74 is formed of a polymeric material to minimize frictional wear of the first thread 64 and to prevent separation of the first component 134 from the first section of material 16. The second section 74 may be further defined as a polymeric button defining the first plurality of apertures 46. In the embodiment shown in FIGS. 7-9, the first component 134, the ring magnet 36, the deflection element 50, and the second section 70 may be disposed in the pocket 70 of the first section 68 with the series of tabs 72 engaging the second section 74 to retain the ring magnet 36, the deflection element 50 and the second section 74.

A second component 152 is at least one of a magnet and a ferromagnetic material, and is used to magnetically couple the second component 152 to the first component 134 and thereby coupling the second section of material 18 to the first section of material 16. The second component 152 also includes a first depression 56 for receiving the first component 34, where the first depression 158 aligns the first component 34 with the second component 52.

In the embodiment shown in FIGS. 7-10, the second component 152 is formed of a ferromagnetic material that includes Iron, Nickel, Cobalt, or any other similar material. It is to be appreciated that the second component 152 could be formed of any suitable metal. The magnet and the ferromagnetic material creates an attraction between the first component 134 and the second component 152 by magnetically attracting the ring magnet 36 of the first component 134.

The second component 152 may include a second coating 56 to prevent corrosion of the second component 152. The second coating 56 helps to protect the second component 152 from rust and/or wear when the second component 152 is subjected to being washed or exposed to other sources of moisture. The second coating 56 is preferably like the first coating 40 and is a fluoropolymer resin, such as Teflon® manufactured by E.I. DuPont de Nemours and Company of Wilmington, Del. As discussed above, Teflon® has excellent resistance to both corrosion and high temperatures and is able to withstand a standard machine washing and drying cycle. Those skilled in the art will realize that other coatings, such as, but not limited to, nickel, will also produce acceptable corrosion resistance.

Referring to FIGS. 11-15, yet another embodiment of the article 10 is shown wherein reference numerals increased by two-hundred represent like or similar elements. The article 10 includes a first component 234 having a body portion 267. As best shown in FIG. 14, the body portion 267 includes a first section 268. The first section 268 is formed of a metallic material and partially surrounds the ring magnet 36. As discussed above, the ring magnet 36 may include a coating to prevent corrosion. The first section 268 includes a pocket 270 for receiving the ring magnet 36. The first section 268 further includes a series of tabs 272 disposed about the pocket 270 for retaining the ring magnet 36 within the pocket 270.

The body portion 267 also includes a second section 274 formed of a polymeric material, and the second section 274 defines the fastening region 244. As discussed above, the fastening region 244 of the second section 274 is formed of a polymeric material to minimize frictional wear of the first thread 64 and to prevent separation of the first component 234 from the first section of material 16. The second section 274 may be further defined as a polymeric button defining the first plurality of apertures 246. In one embodiment of the first component 234, the ring magnet 36 and the second section 270 may be disposed in the pocket 270 of the first section 268, where the series of tabs 272 engage the second section 274 to retain the ring magnet 36 and the second section 274.

Referring to FIG. 15, a second component 276 is shown. Similar to the first component 234, the second component 276 includes a body portion 269 having a first section 278. The first section 278 is sized to receive the first component 234. The first section 278 is formed of a metallic material and partially surrounds a ring magnet 80. As discussed above, the ring magnet 80 may include a coating 40 to prevent corrosion. The first section 278 includes a pocket 82 for receiving the ring magnet 80. It should be appreciated the ring magnet 82 may be sized larger then the ring magnet 36 of the first component 34 of the first embodiment as shown in FIGS. 3-6. The first section 278 further includes a series of tabs 84 disposed about the pocket 82 for retaining the ring magnet 80 within the pocket 82.

The body portion 269 also includes a second section 86 formed of a polymeric material, and the second section 86 defines a fastening region 88. The fastening region 88 of the second section 86 is formed of a polymeric material to minimize frictional wear of the second thread 64 and to prevent separation of the first component 234 from the second section of material 18. The second section 86 may be further defined as a polymeric button defining a third plurality of apertures 90. The ring magnet 80, and the second section 86, may be disposed in the pocket 82 of the first section 278, of the second component 276 with the series of tabs 84 engaging the second section 86 so as to retain the ring magnet 80 and the second section 86.

The second component 276 is configured to receive the first component 234. The second component 276 includes an opening 92 where the second component 276 receives the first component 234. The ring magnet 36 of the first component 234 and the ring magnet 80 of the second component 276 magnetically couple to each other to secure the first component 334 with the second component 276.

Figure 16:
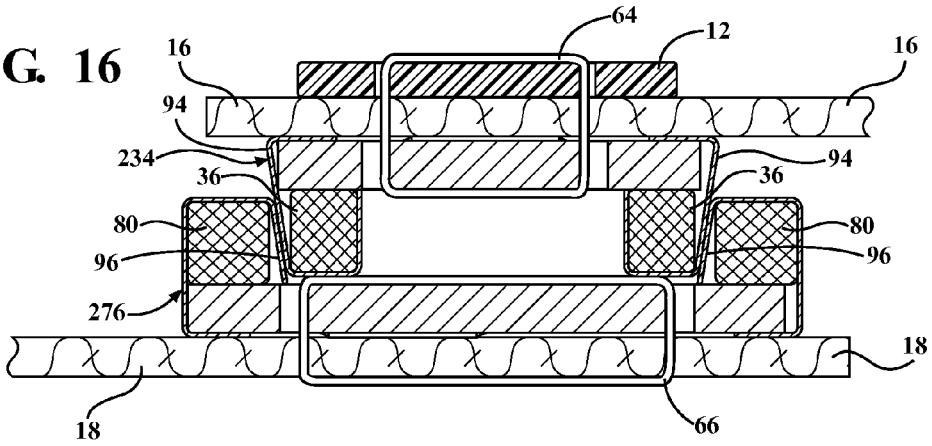
FIG. 16 is a cross-sectional view of a fourth embodiment of the article after a first component and a second component are coupled together.

As best shown in FIG. 13, the first component 234 has an exterior wall 94 and the second component 276 has an interior wall 96. In the current embodiment, the exterior wall 94 of the first portion 234 and the interior wall 96 of the second portion 276 align concentrically when the second portion 276 receives the first portion 234. Alternatively, and as best shown in FIG. 16, the exterior wall 94 and the interior wall 96 may have a tapered profile (see FIG. 16), such that when the second portion 276 receives the first portion 234 the exterior wall 94 and the interior wall align concentrically.

Figure 17:
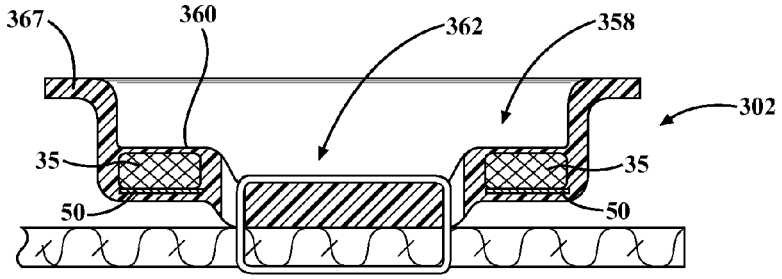
FIG. 17 is a cross-sectional view of a fifth embodiment of a second component of the article.

Referring to FIG. 17, wherein reference numerals increased by three-hundred represent like or similar elements from previously discussed embodiments. A second component 352 may include a ring magnet 35. The second component 352 may also include a deflection element 50 to direct a magnetic field emanating from the ring magnet 35. The second component 352 includes a body portion 367 that may be at least partially formed of a polymeric material that encapsulates the ring magnet 35 and the deflection element 50. A previously discussed, the polymeric material may be further defined as thermoset polymeric material, a thermoplastic polymeric material, or any other suitable polymer or plastic material. Alternatively, the body portion 367 is completely formed of a polymeric material that encapsulates the ring magnet 35 and deflection plate 50.

The second component 352 further includes a first depression 358 that includes a floor 360 and a second depression 362 is formed in the floor 360. However, those skilled in the art will appreciate that the second component 352 could be designed without a second depression 362 without departing from the scope of the present invention. The second component 352 also includes a third plurality of apertures 346. The third plurality of apertures 346 may be further defined as four apertures radially spaced with respect to the second depression 362. It is to be appreciated that the third plurality of apertures 46 may also include any number of apertures spaced in any suitable configuration. It is to be appreciated that any second component, described above, may be used in combination with any of the first components, described above, to magnetically couple the first section of material 16 with the second section of material 18.

Figure 18:
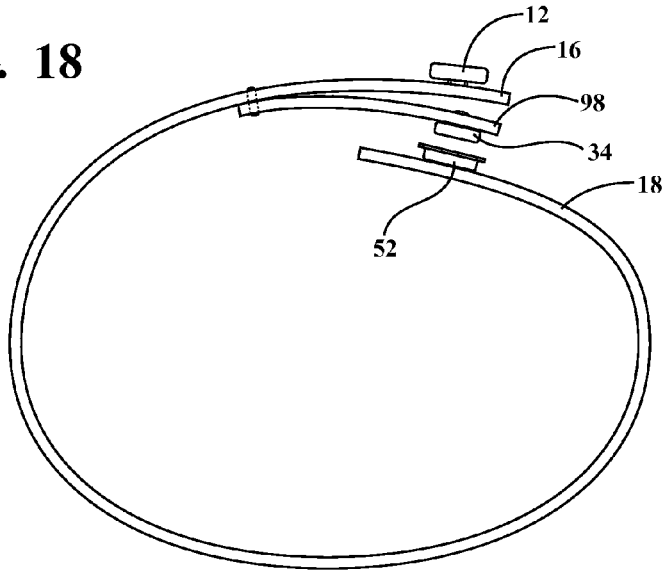
FIG. 18 is an end-view illustrating an alternative sleeve arrangement for supporting the article.

Referring to FIG. 18, the article may include a third section of material 98. The third section of material 98 is secured to the first section of material 16 and extends from the first section of material 16. However, it is to be appreciated that the third section of material 98 could also extend from the second section of material 18, or could extend from any suitable location. In the one embodiment, the first component 34 is coupled to the third section of material 98. However, it is to be appreciated that the handle 12, or second component 52 could be coupled to the third section of material 98. It is to be appreciated that each of the handle 12, first component 34, or second component 52, may be placed in any combination with the first section of material 16, the second section of material 18, and the third section of material 98.

In this way, the article 10 is easy to operate and is especially useful for persons who lack fine motor coordination. Those skilled in the art will appreciate how the article enable easy alignment of the first component 34 and the second component 52 for a person who lacks fine motor coordination. Furthermore, when the article 10 is used on apparel, a handle 12 is embodied as a button to provide increased aesthetic value.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. An article comprising:

a first section of material having a first surface;

a second section of material having a second surface; a magnetic button assembly comprising;

a first component coupled to said first section of material adjacent said first surface with said first component having a ring magnet defining a central opening and a body portion coupled to said ring magnet with said body portion having a fastening region defining a first plurality of apertures disposed across said central opening, a second component coupled to said second section of material adjacent said second surface with said second component defining a second plurality of apertures and comprising at least one of a magnet and a ferromagnetic material to magnetically couple said second component to said first component thereby coupling said second section of material to said first section of material;

a first thread disposed through said first plurality of apertures of said fastening region to secure said first component to said first section of material; and a second thread disposed through said second plurality of apertures to secure said second component to said second section of material;

wherein said fastening region of said body portion is formed of a polymeric material to minimize frictional wear of said first thread to prevent separation of said first component from said first section of material;

wherein the body portion and the fastening region are a contiguous, monolithic body and the body portion and fastening region fully encapsulate the inner and outer surfaces of the ring magnet as a single body of polymeric material.

2. An article as set forth in claim 1 wherein said first component includes a deflection element coupled to said ring magnet for directing a magnetic field emanating from said ring magnet.

3. An article as set forth in claim 1 wherein said ring magnet includes a coating for preventing corrosion of said ring magnet.

4. An article as set forth in claim 1 wherein said second component includes a first depression for receiving said first component and for aligning said first component with said second component.

5. An article as set forth in claim 4 wherein said first depression includes a floor, said second component further including a second depression formed in said floor where said second plurality of apertures are formed within said second depression.

6. An article as set forth in claim 1 wherein said second component includes a coating to prevent corrosion of said second component.

7. An article as set forth in claim 1 wherein said article includes a handle coupled to and disposed on said first section of material opposite said first surface.

8. An article as set forth in claim 1 wherein said body portion include a depression with said first plurality of apertures disposed through said depression.

9. An article as set forth in claim 1 wherein said body portion has a first section formed of a metallic material partially surrounding said ring magnet.

10. An article as set forth in claim 9 wherein said first section includes a pocket for receiving said ring magnet.

11. An article as set forth in claim 10 wherein said first section includes a series of tabs disposed about said pocket for retaining said ring magnet within said pocket.

12. An article as set forth in claim 9 wherein said body portion has a second section formed of a polymeric material with said fastening region being defined within said second section.

13. An article as set forth in claim 12 wherein said second section is a polymeric button defining said first plurality of apertures.

14. An article as set forth in claim 12 wherein said first section include a pocket for receiving said ring magnet and a series of tabs with said tabs engaging said second section to retain said ring magnet within said pocket.

15. An article as set forth in claim 1 wherein said second component includes a ring magnet.

16. An article as set forth in claim 15 wherein said second component is at least partially formed of a polymeric material encapsulating said ring magnet.

17. An article as set forth in claim 15 wherein said second component is entirely formed of a polymeric material encapsulating said ring magnet.

18. An article as set forth in claim 1 wherein at least one of said first and second sections of material includes a third section of material secured to said one of said first and second sections of material and extending therefrom with one of said first and second components coupled to said third section.

19. A magnetic button assembly for coupling a first section of material to a second section of material; said magnetic button assembly comprising;

a first component having a ring magnet defining a central opening and a body portion coupled to said ring magnet with said body portion having a fastening region defining a first plurality of apertures disposed across said central opening, for permitting said first component to be secured to said first section of material; and a second component defining a second plurality of apertures for permitting said second component to be secured to said second section of material, said second component comprising at least one of a magnet and a ferromagnetic material to magnetically couple said second component to said first component for coupling the second section of material to the first section of material;

wherein said fastening region of said body portion is formed of a polymeric material; and wherein the body portion and the fastening region are a contiguous, monolithic body and the body portion and fastening region fully encapsulate the inner and outer surfaces of the ring magnet as a single body of polymeric material.

20. An article as set forth in claim 19 wherein said body portion is entirely formed of a polymeric material with said body portion and said fastening region being formed simultaneously.

21. An article as set forth in claim 19 wherein said body portion has a first section formed of a metallic material partially surrounding said ring magnet.

22. An article as set forth in claim 21 wherein said body portion has a second section formed of a polymeric material with said fastening region being defined within said second section.

23. An article as set forth in claim 22 wherein said first section include a pocket for receiving said ring magnet and a series of tabs with said tabs engaging said second section to retain said ring magnet within said pocket.

* * * * *